US009435248B2

(12) United States Patent
Park et al.

(10) Patent No.: US 9,435,248 B2
(45) Date of Patent: Sep. 6, 2016

(54) ENGINE HAVING COOLANT CONTROL VALVE

(71) Applicants: Hyundai Motor Company, Seoul (KR); Kia Motors Corporation, Seoul (KR)

(72) Inventors: Yoonghwa Park, Seongnam-si (KR); Jongho Lee, Yongin-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 123 days.

(21) Appl. No.: 14/546,139

(22) Filed: Nov. 18, 2014

(65) Prior Publication Data

US 2015/0354436 A1 Dec. 10, 2015

(30) Foreign Application Priority Data

Jun. 5, 2014 (KR) ..... 10-2014-0068534

(51) Int. Cl.
*F01P 7/14* (2006.01)
*F01P 3/02* (2006.01)

(52) U.S. Cl.
CPC .. *F01P 7/14* (2013.01); *F01P 3/02* (2013.01); *F01P 2007/146* (2013.01)

(58) Field of Classification Search
CPC ..... F01P 2007/146; F01P 7/14; F01P 3/00; F01P 7/048
USPC ..... 123/41.08, 41.16, 41.01, 41.4, 41.58
See application file for complete search history.

(56) References Cited

U.S. PATENT DOCUMENTS

| | | | | |
|---|---|---|---|---|
| 8,881,693 | B2 * | 11/2014 | Hayashi | F01P 7/167 123/41.01 |
| 2012/0048217 | A1 * | 3/2012 | Triebe | F01P 7/14 123/41.1 |
| 2012/0312256 | A1 * | 12/2012 | Komurian | F01P 7/167 123/41.44 |
| 2013/0167786 | A1 * | 7/2013 | Mehring | F02F 1/10 123/41.82 R |
| 2013/0186351 | A1 * | 7/2013 | Quix | F01P 5/10 123/41.02 |
| 2014/0026829 | A1 * | 1/2014 | Tobergte | F01P 3/02 123/41.1 |

FOREIGN PATENT DOCUMENTS

| | | | |
|---|---|---|---|
| JP | 6-212970 | A | 8/1994 |
| JP | 2008-255852 | A | 10/2008 |
| JP | 2009-144624 | A | 7/2009 |
| JP | 2013-177843 | A | 9/2013 |
| KR | 10-2009-0065294 | A | 6/2009 |
| KR | 10-2013-0019172 | A | 2/2013 |

* cited by examiner

*Primary Examiner* — Lindsay Low
*Assistant Examiner* — Long T Tran
(74) *Attorney, Agent, or Firm* — Morgan, Lewis & Bockius LLP

(57) ABSTRACT

An engine having a coolant control valve may include a sealing ring including a sealing ring inlet and sealing ring outlets, a valve housing to rotatably house the sealing ring therein, wherein discharge outlets are formed corresponding to the sealing ring outlets, a drive portion coupled to the sealing ring to selectively rotate the sealing ring, and a blocking wall that is disposed to the one end portion of the sealing ring to block a part of the one end portion of the sealing ring to form the sealing ring inlet, wherein the blocking wall is selectively rotated about a central axis thereof in accordance with a rotation of the sealing ring, wherein the blocking wall selectively blocks a first coolant line of a cylinder head or a second coolant line of a cylinder block depending on a rotation position of the sealing ring.

10 Claims, 6 Drawing Sheets

ENGINE HAVING COOLANT CONTROL VALVE

CROSS-REFERENCE TO RELATED APPLICATION

The present application claims priority to and the benefit of Korean Patent Application No. 10-2014-0068534 filed on Jun. 5, 2014, the entire contents of which is incorporated herein for all purposes by this reference.

BACKGROUND OF THE INVENTION

1. Field of the Invention

The present invention is related to an engine having a coolant control valve that respectively controls coolant passing a cylinder head and a cylinder block such that engine warming up time is reduced and fuel consumption is saved.

2. Description of Related Art

The engine generates a torque by burning fuel, and exhausts the remainder in thermal energy. Particularly, cooling water absorbs heat while circulating the engine, a heater and a radiator and dissipates the heat to an outside of the engine.

If a cooling water temperature of the engine is low to elevate oil viscosity, it is a trend that friction force and fuel consumption increases and a temperature of exhaust gas rises slowly resulting to prolong a time period of catalyst activation to make a quality of the exhaust gas poor. Along with this, there is a trend that a time period for bringing a heater function to a normal level takes a long time to make occupants and a driver to feel cold.

If the cooling water temperature of the engine is excessive, knocking takes place, and, if ignition timing is adjusted for suppressing the knocking, performance is liable to become poor. And, if a lubrication oil temperature is excessive, a lubrication action is liable to become poor.

Accordingly, a temperature of a specific section of an engine is maintained to be high and that of other section of the engine is maintained to be low, wherein one integrated flow rate valve is used to control several cooling elements.

Particularly, because the cylinder head and the cylinder block are separately cooled, the passage of the coolant becomes complicated, and coolant control valve has been being researched for respectively controlling the coolant.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an engine having a coolant control valve having advantages of respectively controlling coolant passing a cylinder head and a cylinder block through a structure improvement such that warming up time is reduced and fuel consumption is saved.

An engine having a coolant control valve, may include a sealing ring that may have a pipe shape, wherein a sealing ring inlet is formed at an end portion of the sealing ring and sealing ring outlets are formed at a predetermined position from an inner surface to an outer surface of the sealing ring, a valve housing that a mounting space is formed therein to rotatably house the sealing ring therein, wherein the valve housing may have an interior circumference corresponding to an exterior circumference of the sealing ring, and discharge outlets are formed corresponding to the sealing ring outlets, a drive portion that is coupled to the sealing ring to selectively rotate the sealing ring such that the sealing ring outlets match the discharge outlets and a coolant that flows in the sealing ring is supplied to the discharge outlets, and a blocking wall that is disposed to the one end portion of the sealing ring to block a part of the one end portion of the sealing ring to form the sealing ring inlet, wherein the blocking wall is selectively rotated about a central axis thereof in accordance with a rotation of the sealing ring, wherein the blocking wall selectively blocks a first coolant line of a cylinder head or a second coolant line of a cylinder block depending on a rotation position of the sealing ring.

The blocking wall is integrally formed with the sealing ring.

The engine having the coolant control valve may include a plate that is engaged with the valve housing, wherein an inner side surface of the plate corresponds to the sealing ring inlet or the blocking wall of the sealing ring, wherein a first passage for the first coolant line and a second passage for the second coolant line are formed to the plate to correspond to the sealing ring inlet, and wherein the blocking wall of the sealing ring blocks the first passage or the second passage depending on the rotation position thereof.

An outer side surface of the blocking wall slidably contacts an inner side surface of the plate.

The blocking wall is configured to close all of the first passage and the second passage, the blocking wall is configured to close one of the first passage and the second passage, or the blocking wall is configured to open all of the first passage and the second passage accordion to the rotation position of the sealing ring.

The blocking wall may have a semi-circular shape about the central axis, and the first passage and the second passage may have a fan shape that divides the blocking wall into two sides.

A first outlet that discharges coolant for cooling the cylinder head and a connection passage that receives coolant for cooling the cylinder block that is disposed under the cylinder head are formed in the cylinder head, wherein a second outlet for discharging coolant that flows through the connection passage is formed in the cylinder head, wherein the first outlet is formed near the second outlet.

One of the discharge outlets is connected to an EGR cooler for cooling recirculated exhaust gas, and another of the discharge outlets is connected to a radiator that radiates heat through outside air.

The valve housing is directly engaged with the cylinder head through the plate.

The drive portion may include an electric motor.

In accordance with the present invention for realizing above objects, coolant that cools a cylinder head and a cylinder block is separately controlled such that the overall cooling efficiency is improved.

Further, the coolant that flow the cylinder head or the cylinder block is blocked depending on driving conditions such that the overall warming up time is reduced, heater performance is improved, and harmful material of exhaust gas is decreased, and fuel consumption is decreased.

Also, a coolant control valve is mounted on a cylinder head to simplify cooling passages, and a valve for blocking coolant of cylinder block is eliminated to save cost.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
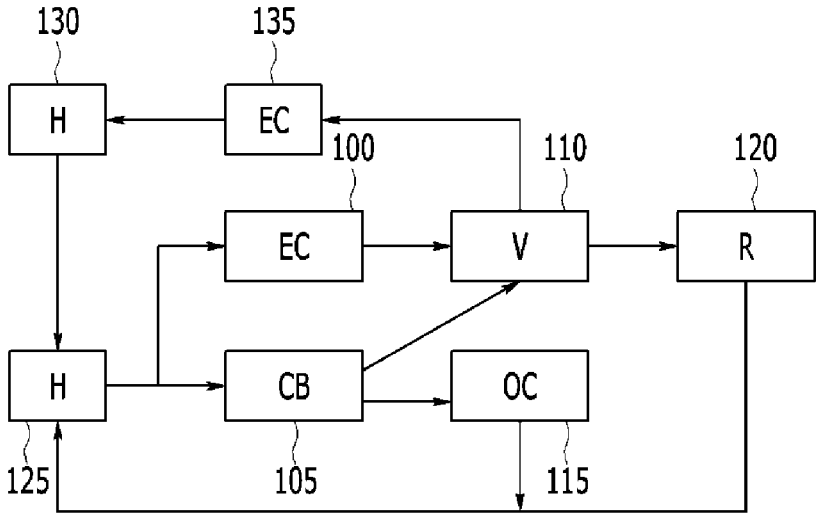
FIG. 1 is a schematic diagram of an engine having a coolant control valve according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a schematic diagram of an engine having a coolant control valve according to an exemplary embodiment of the present invention.

Referring to FIG. 1, an engine having a coolant control valve includes a cylinder block 105, a cylinder head 100, a coolant control valve 110, a radiator 120, an EGR cooler 135, an oil cooler 115, a heater 130, and a coolant pump 125.

The coolant that is pumped by the coolant pump 125 is respectively supplied to the cylinder head 100 and the cylinder block 105, and the coolant passing the cylinder block 105 and the cylinder head 100 joins the coolant control valve 110.

The coolant control valve 110 selectively supplies the EGR cooler 135 or the radiator 120 with coolant depending on driving conditions. The coolant that is supplied to the EGR cooler 135 passes the heater 130 to be circulated to the coolant pump, and the coolant that is supplied to the radiator 120 is circulated to the coolant pump 125. And, a part of the coolant passing the cylinder block 105 passes the oil cooler 115 to be circulated to the coolant pump 125.

In an exemplary embodiment of the present invention, the coolant control valve 110 supplies the EGR cooler 135 or the radiator 120 with coolant, but the coolant control valve 110 can selectively supply the heater 130, the EGR cooler 135, or the radiator 120 with coolant.

In an exemplary embodiment of the present invention, the coolant control valve 110 respectively controls the coolant passing the cylinder head 100 and the cylinder block 105, wherein the coolant that is supplied to the cylinder block 105 can be blocked and the coolant is supplied to the cylinder head 100 in a condition that the coolant temperature is lower than a predetermined value.

Further, the coolant is selectively circulated to the radiator 120 depending on the driving conditions, and thus the coolant temperature can be maintained within a predetermined range.

Figure 2:
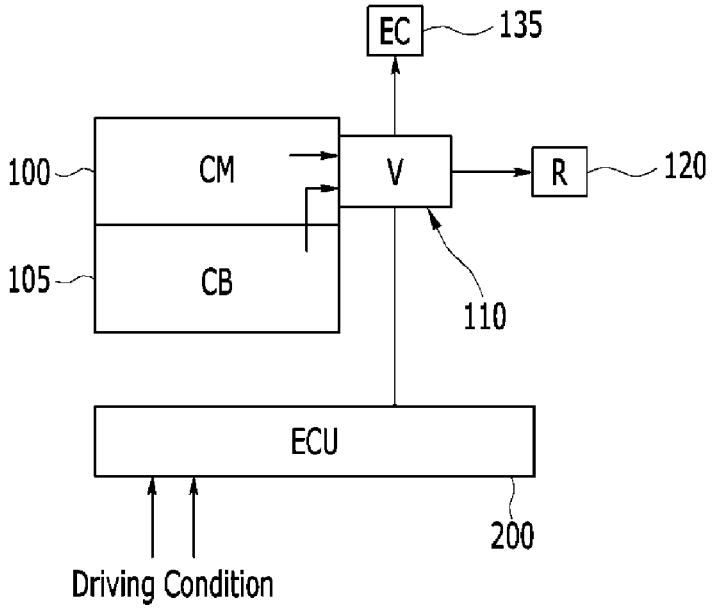
FIG. 2 is a partial schematic diagram of an engine having a coolant control valve according to an exemplary embodiment of the present invention.

FIG. 2 is a partial schematic diagram of an engine having a coolant control valve according to an exemplary embodiment of the present invention. The detailed description of parts those are similar to FIG. 1 will be omitted, and the parts those are different from that will be further explained.

Referring to FIG. 2, a control portion 200 controls the coolant control valve 110 depending on driving conditions such that the coolant passing the cylinder head 100, the cylinder block 105, the EGR cooler 135, and the radiator 120 is respectively controlled. In an exemplary embodiment of the present invention, the driving condition can include coolant temperature, vehicle driving load, rotation speed, and so on.

Figure 3:
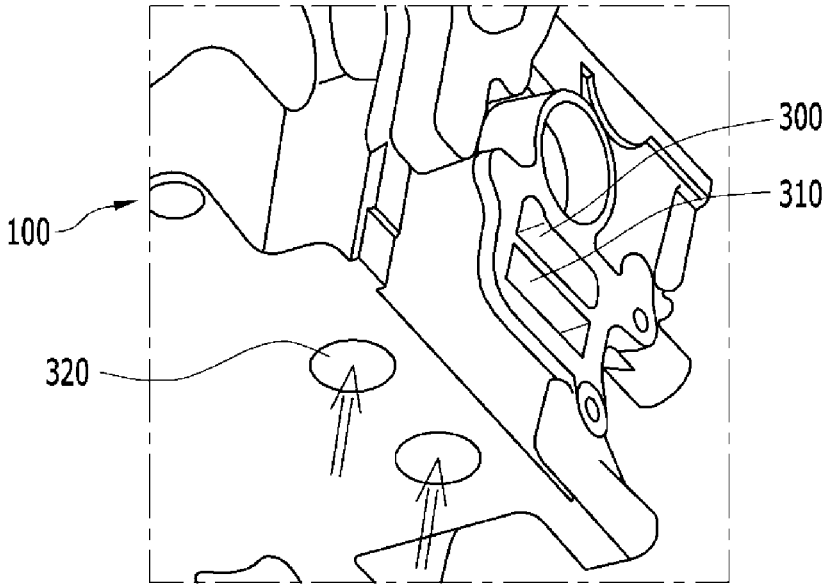
FIG. 3 is a partial perspective view of a cylinder head in an engine having a coolant control valve according to an exemplary embodiment of the present invention.

FIG. 3 is a partial perspective view of a cylinder head in an engine having a coolant control valve according to an exemplary embodiment of the present invention.

Referring to FIG. 3, a connection passage 320 is formed at a lower side of the cylinder head 100 to receive the coolant passing the cylinder block 105, and a first outlet 300 and a second outlet 310 are formed on a side surface of the cylinder head 100 adjacent to each other in an upper and lower direction.

The coolant passing the cylinder block 105 passes through the connection passage 320 to be exhausted through the second outlet 310 and the coolant passing the cylinder head 100 is exhausted through the first outlet 300.

Figure 4:
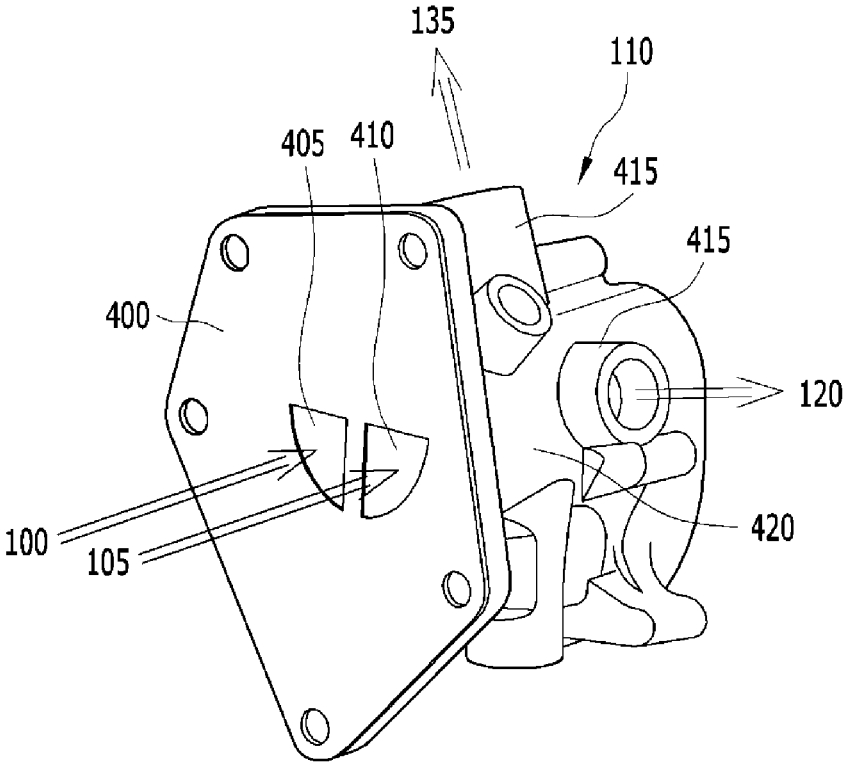
FIG. 4 is a partial perspective view of a coolant control valve according to an exemplary embodiment of the present invention.

FIG. 4 is a partial perspective view of a coolant control valve according to an exemplary embodiment of the present invention.

Referring to FIG. 4, a coolant control valve 110 includes a plate 400 and a valve housing 420. At least two outlets 415 are formed at a side surface of the valve housing 420, one of them is connected to the EGR cooler 135, and another is connected to the radiator 120.

A plate 400 is mounted on a surface corresponding to the cylinder head 100, that is a front surface of the valve housing 420, and a first passage 405 and a second passage 410 are formed in the plate 400.

In an exemplary embodiment of the present invention, the first passage 405 can correspond to the first outlet 300 of the cylinder head 100, and the second passage 410 can correspond to the second outlet 310 of the cylinder head 100.

Figure 5:
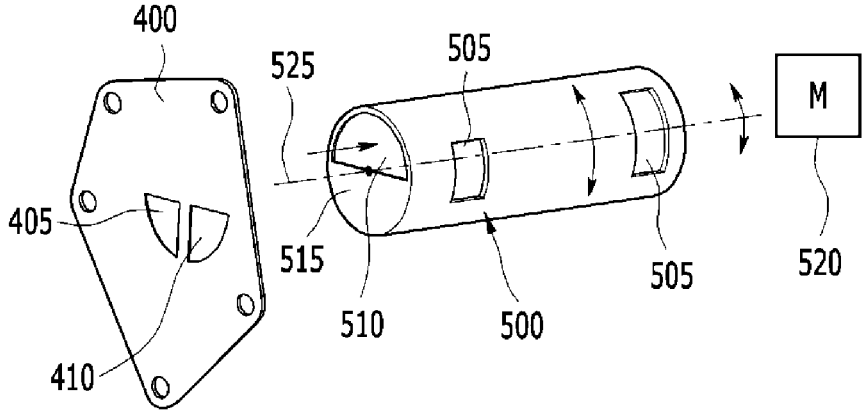
FIG. 5 is a partial exploded perspective view of a coolant control valve according to an exemplary embodiment of the present invention.

FIG. 5 is a partial exploded perspective view of a coolant control valve according to an exemplary embodiment of the present invention, wherein the coolant control valve 110 includes a plate 400, a sealing ring 500, and a motor 520.

Referring to FIG. 5, the sealing ring 500 has a pipe shape that a cylindrical space is formed therein along a central axis of a length direction, and a sealing ring inlet 510 that is opened to an outside is formed on a front end portion thereof.

The sealing ring inlet 510 has a circular shape along an interior circumference of the sealing ring 500, and a semi circular blocking wall 515 is formed in the sealing ring inlet 510. The blocking wall 515 is integrally formed with the sealing ring 500, and the blocking wall is disposed to be rotated together with the sealing ring 500 with respect to the central axis 525.

And, a sealing ring outlet 505 is formed in the sealing ring 500. The coolant that flows into the sealing ring inlet 510 of the sealing ring 500 flows through the sealing ring outlet 505 and the discharge outlet 415 of the valve housing 420, and supplies to the EGR cooler 135 and the radiator 120.

Here, the sealing ring outlet 505 corresponds to the discharge outlet 415 in accordance with the rotation position of the sealing ring 500, the coolant flows through the sealing ring outlet 505 and the discharge outlet 415, and if the sealing ring outlet 505 does not correspond to the discharge outlet 415, the coolant passage is closed.

The first passage 405 and the second passage 410 are formed in the plate corresponding to the rotation area of the blocking wall 515 of the sealing ring 500, and an inner side surface of the plate 400 slidably contacts the blocking wall 515.

As shown in the drawings, the blocking wall 515 has a semi circular shape, and the first passage 405 and the second passage 410 has a fan shape that divides the semi circular shape into two. Accordingly, the blocking wall 515 closes the first passage 405, closes the second passage 410, or closes the first passage 405 and the second passage 410 in accordance with the rotation of the sealing ring 500.

In an exemplary embodiment of the present invention, the blocking wall 515 of the sealing ring 500 selectively closes the first passage 405 and the second passage 410 such that the coolant flowing the first outlet 300 and the second outlet 310 of the cylinder head 100 is selectively closed. That is, the coolant that respectively flows the cylinder head 100 and the cylinder block 105 can be separately controlled.

Figure 6:
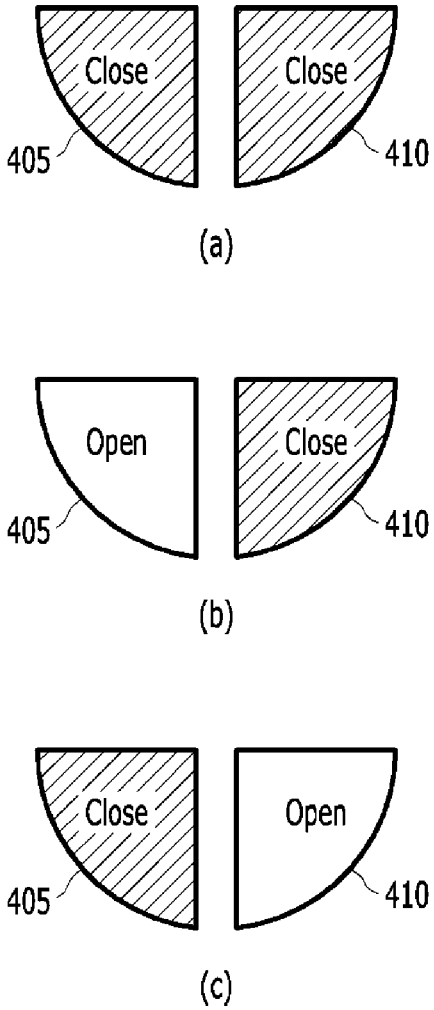
FIG. 6 shows a flow passage change depending on a rotation position of a sealing ring of a coolant control valve according to an exemplary embodiment of the present invention.

FIG. 6 shows a flow passage change depending on a rotation position of a sealing ring of a coolant control valve according to an exemplary embodiment of the present invention.

Referring to FIG. 6, a control portion 200 controls the motor 520 so as to control the rotation position of the sealing ring 500.

And, in (a), the blocking wall 515 and the sealing ring inlet 510 closes all the first passage 405 and the second passage 410 of the plate 400.

In (b), the blocking wall 515 and the sealing ring inlet 510 opens the first passage 405 of the plate 400 and closes the second passage 410 thereof.

In (c), the blocking wall 515 and the sealing ring inlet 510 closes the first passage 405 of the plate 400 and opens the second passage 410.

Further, the blocking wall 515 and the sealing ring inlet 510 can open the first passage 405 and the second passage 410.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. They are not intended to be exhaustive or to limit the invention to the precise forms disclosed, and obviously many modifications and variations are possible in light of the above teachings as well as various alternatives and modifications thereof. It is intended that the scope of the invention be defined by the Claims appended hereto and their equivalents.

What is claimed is:

1. An engine having a coolant control valve, comprising:

a sealing ring that has a pipe shape, wherein a sealing ring inlet is formed at an end portion of the sealing ring and sealing ring outlets are formed at a predetermined position from an inner surface to an outer surface of the sealing ring;

a valve housing that a mounting space is formed therein to rotatably house the sealing ring therein, wherein the valve housing has an interior circumference corresponding to an exterior circumference of the sealing ring, and discharge outlets are formed corresponding to the sealing ring outlets;

a drive portion that is coupled to the sealing ring to selectively rotate the sealing ring such that the sealing ring outlets match the discharge outlets and a coolant that flows in the sealing ring is supplied to the discharge outlets; and a blocking wall that is disposed to the one end portion of the sealing ring to block a part of the one end portion of the sealing ring to form the sealing ring inlet, wherein the blocking wall is selectively rotated about a central axis thereof in accordance with a rotation of the sealing ring, wherein the blocking wall selectively blocks a first coolant line of a cylinder head or a second coolant line of a cylinder block depending on a rotation position of the sealing ring.

2. The engine having the coolant control valve of claim 1, wherein the blocking wall is integrally formed with the sealing ring.

3. The engine having the coolant control valve of claim 1, comprising:

a plate that is engaged with the valve housing, wherein an inner side surface of the plate corresponds to the sealing ring inlet or the blocking wall of the sealing ring, wherein a first passage for the first coolant line and a second passage for the second coolant line are formed to the plate to correspond to the sealing ring inlet, and wherein the blocking wall of the sealing ring blocks the first passage or the second passage depending on the rotation position thereof.

4. The engine having the coolant control valve of claim 3, wherein an outer side surface of the blocking wall slidably contacts an inner side surface of the plate.

5. The engine having the coolant control valve of claim 3, wherein the blocking wall is configured to close all of the first passage and the second passage, the blocking wall is configured to close one of the first passage and the second passage, or the blocking wall is configured to open all of the first passage and the second passage accordion to the rotation position of the sealing ring.

6. The engine having the coolant control valve of claim 3, wherein the blocking wall has a semi-circular shape about the central axis, and the first passage and the second passage have a fan shape that divides the blocking wall into two sides.

7. The engine having the coolant control valve of claim 3, wherein the valve housing is directly engaged with the cylinder head through the plate.

8. The engine having the coolant control valve of claim 1, wherein a first outlet that discharges coolant for cooling the cylinder head and a connection passage that receives coolant for cooling the cylinder block that is disposed under the cylinder head are formed in the cylinder head, and wherein a second outlet for discharging coolant that flows through the connection passage is formed in the cylinder head, wherein the first outlet is formed near the second outlet.

9. The engine having the coolant control valve of claim 1, wherein one of the discharge outlets is connected to an EGR cooler for cooling recirculated exhaust gas, and another of the discharge outlets is connected to a radiator that radiates heat through outside air.

10. The engine having the coolant control valve of claim 1, wherein the drive portion includes an electric motor.

* * * * *